United States Patent [19]

Sobotka, Jr. et al.

[11] Patent Number: 4,965,414

[45] Date of Patent: Oct. 23, 1990

[54] CIRCUIT BREAKER AND RESET MECHANISMS OPERATED THROUGH THE BODY

[75] Inventors: Edward W. Sobotka, Jr., Baldwinsville; Martin P. Piraino, Jr., Syracuse, both of N.Y.

[73] Assignee: Cooper Industries, Inc., Houston, Tex.

[21] Appl. No.: 330,855

[22] Filed: Mar. 31, 1989

[51] Int. Cl.[5] ..... H01H 9/00

[52] U.S. Cl. ..... 200/50 A

[58] Field of Search ..... 200/50 R, 50 A, 17 R, 200/293, 306, 302.1, 302.3, 329, 330, 331, 332

[56] References Cited

U.S. PATENT DOCUMENTS

| | | | |
|---|---|---|---|
| 2,654,011 | 9/1953 | Kingdon | 200/50 A X |
| 3,264,443 | 8/1966 | Farina et al. | 200/50 A X |
| 3,335,238 | 8/1967 | Zavertnik et al. | 200/50 A |
| 3,777,084 | 12/1973 | Rys | 200/50 A |
| 4,034,170 | 7/1977 | Raabe et al. | 200/50 A |
| 4,572,932 | 2/1986 | Sanders | 200/17 R |

OTHER PUBLICATIONS

Cooper Industries, Inc., WSD Enclosed Switches, Sep. 1987, pp. 2A-2.1 and 2A-1.

*Primary Examiner*—J. R. Scott

*Attorney, Agent, or Firm*—Nelson A. Blish; Gregory L. Maag

[57] ABSTRACT

An explosion-proof enclosure having a side mounted circuit breaker handle 30, and side mounted motor controller reset handle 38. Bolt holes (46) have been eliminated in the vicinity of breaker handle 30 and reset handle 38 to allow rotation of the handles without reducing the width of explosion-proof joint (44) and without increasing the overall width of the enclosure. Mounting breaker handle 30 and reset handle 38 on the side of the explosion-proof enclosure allows the handles to be aligned, adjusted and tested with enclosure cover either in the open or closed position.

16 Claims, 2 Drawing Sheets

CIRCUIT BREAKER AND RESET MECHANISMS OPERATED THROUGH THE BODY

This invention pertains to explosion-proof enclosures in general, and in particular to operating mechanisms that operate through the side body of the enclosure for circuit breakers and motor controllers.

BACKGROUND OF THE INVENTION

Explosion-proof enclosures are used to contain circuit breakers and motor controllers in an atmosphere such that any flames or arcs are contained within the explosion-proof enclosure. The enclosures are comprised of cast metal body and covers which are usually bolted together. It is often necessary to actuate the breaker or reset the motor controller without opening the cover of the enclosure. Thus operating handles or mechanisms must be provided on the exterior of the enclosure.

Prior art explosion proof enclosures have used operating mechanisms on the cover of the enclosure to operate the circuit breaker and motor controller. A problem has been encountered in that since the cover is hinged it is often difficult, if not impossible, to align the operating mechanisms with the circuit breaker handle and the motor controller, with the cover in the closed position. Therefore it is desireable to provide operating mechanisms for circuit breakers and controllers in explosion-proof enclosures that can be aligned and adjusted while the cover of the enclosure is in the open position.

SUMMARY OF THE INVENTION

In the present invention the circuit breaker operating handle is mounted on the side of the explosion-proof enclosure so that the circuit breaker operating handle can be aligned, adjusted, and tested with the cover of the explosion-proof enclosure in the open position. In a similar fashion the reset handle for the motor controller is mounted on the side of the enclosure body so that the motor controller reset can be aligned, adjusted and tested with the cover in the open position. The flange width of the cover and body have been reduced in the area of the operator handles, to allow rotation of the breaker operating handle and reset handle.

DETAILED DESCRIPTION OF THE DRAWINGS

Figure 1:
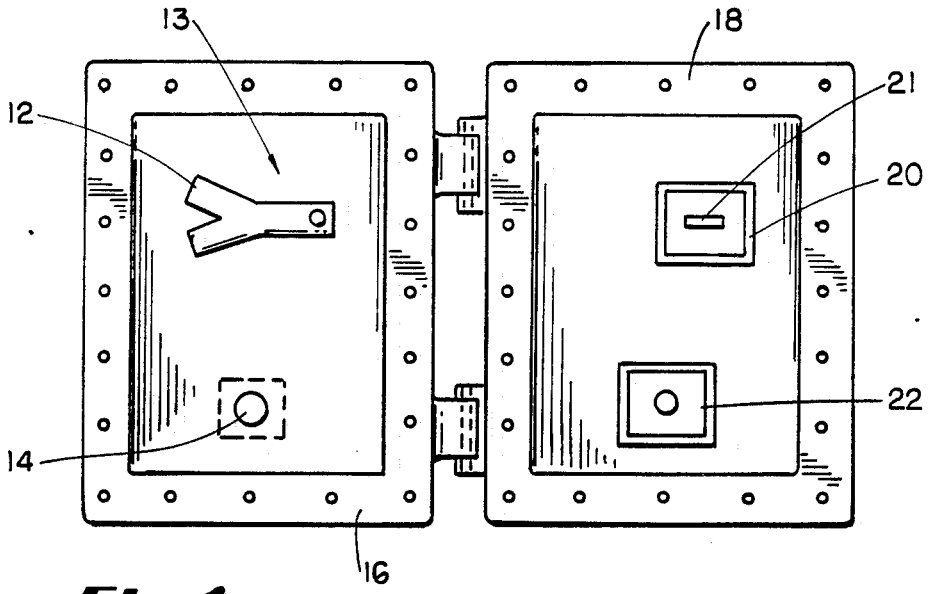
Fig. 1 (PRIOR ART)
FIG. 1 shows a prior art enclosure in a plan view with the cover open.

FIG. 1 shows a prior art enclosure with cover 16 in the open position. Reset button 14 is mounted in the cover as is circuit breaker fork 12. When circuit breaker fork 12 is rotated in a clockwise direction as shown by arrow 13 it will move switch 21 on circuit breaker into the closed position. A difficulty is encountered in that the exact amount of travel necessary for circuit breaker operating fork 12 cannot properly be determined without fork 12 engaging switch 21. This cannot be done with the cover 16 in an open position. In a similar manner motor controller 22, which is mounted in enclosure body 18 cannot be adjusted with cover 16 in the open position. Also, there is a danger in the prior art method described that over rotation of fork 12 will cause damage to switch 21 or circuit breaker 20.

Figure 2:
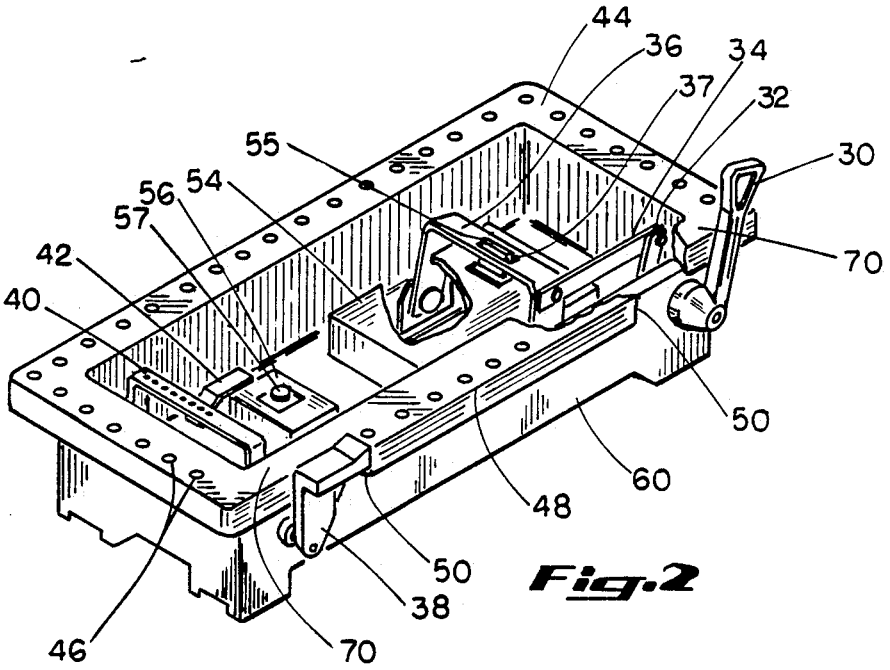
FIG. 2 shows a perspective view of an explosion-proof enclosure according to the present invention.
Figure 3:
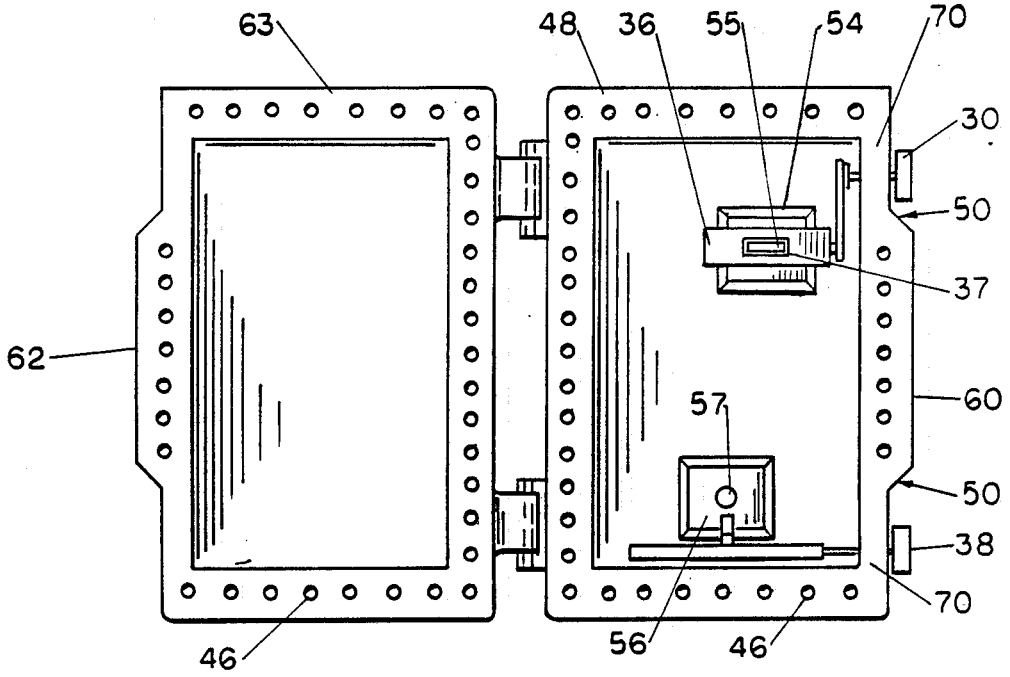
FIG. 3 shows a plan view of the explosion-proof enclosure of FIG. 2.

In the present invention shown in FIG. 2 and FIG. 3 circuit breaker operating handle 30 is mounted on the body 60 of an explosion-proof enclosure, the enclosure further including a cover 62 (FIG. 3) and housing a circuit breaker 54 and motor controller 56. Handle 30 operates drive arm 32 which moves connector arm 34 to rotate bail 36. Bail 36 moves the circuit breaker reset switch 55 shown in FIG. 2 and FIG. 3 to the open or closed position, bail 36 engaging switch 55 by means of slot 37. The circuit breaker 54 is positioned within the enclosure such that switch 55 extends through slot 37 in bail 36. In a similar manner reset handle 38 is mounted on the side of body 18 and rotates reset hinge 40. Reset finger 42 mounted on hinge 40 depresses reset button 57 for motor controller 56 shown in FIG. 2 and FIG. 3. Motor controller 56 is positioned within the enclosure such that reset button 57 is in the arcuate path of travel of reset finger 42 and is depressed by finger 42 when reset handle 38 is actuated. In the present invention handle 30 and reset handle 38 are mounted on body 60 so as not to substantially increase the overall width of the enclosure. To achieve this purpose, flange 48 of body 60 and flange 63 of cover 62 include reduced width sections 70 adjacent to handles 30 and 38 formed at indentations 50 to allow handles 30 and 38 to pivot in arcuate paths so as to actuate circuit breaker switch 55 and motor controller reset button 57. Because the width of flanges 48 and 63 are reduced at indentations 50, thereby forming reduced width sections 70, bolt holes 46 have been eliminated in the vicinity of handles 30, 38 in reduced width sections 70. This enables handle 30 and handle 38 to be mounted close to the body, thus saving space without reducing the area of explosion-proof joint 44 formed by flange 48 and flange 63. Explosion-proof joint 44 must be of a minimum, predetermined width in order to provide for cooling of gases escaping from the explosion-proof enclosure to the outside atmosphere.

Thus it seems that circuit breakers and motor controllers operated in an explosion-proof enclosure according to the present invention can be operated, adjusted and aligned with the cover in the open position.

We claim:

1. An explosion-proof enclosure for electrical components, comprising:

a cast metal body;

a cast metal cover bolted to said body along an explosion proof joint formed between said body and said cover;

an operating handle pivotably mounted on the side of said body, said operating handle being free from attachment to said cover; and aligned and opposing flanges formed on said body and said cover and forming said explosion proof joint therebetween, wherein said flanges include indentations in the region adjacent to said operating handle, and wherein said operating handle is pivotable in an arcuate path through said indentations.

2. An explosion-proof enclosure comprising:

a cast metal body;

a removable cast metal cover;

a circuit breaker mounted in said body, said circuit breaker having an actuator switch;

an external operating handle pivotably mounted on said body;

pivotable linkage inside said body connected to said operating handle and engaging said actuator switch;

wherein said circuit breaker is mounted in said body such that said actuator switch is actuated by said linkage upon actuation of said operating handle and pivoting of said linkage, such that said circuit breaker can be tested, operated and aligned with said cover open or closed; and wherein said metal body and said metal cover have aligned and opposing flanges and wherein said flanges have indentations forming regions of reduced width in the area of said operating handle, and wherein said operating handle is pivotable in an arcuate path passing through said indentations.

3. An explosion-proof enclosure comprising:

a cast metal body;

a removable cast metal cover;

a circuit breaker mounted in said body, said circuit breaker having an actuator switch;

an external operating handle pivotably mounted on said body;

pivotable linkage inside said body connected to said operating handle and engaging said actuator switch;

wherein said circuit breaker is mounted in said body such that said actuators switch is actuated by said linkage upon actuation of said operating handle and pivoting of said linkage, such that said circuit breaker can be tested, operated and aligned with said cover open or closed;

an external reset handle pivotably mounted on said body;

a motor controller mounted in said body, said controller having a reset button; and a second linkage inside said body connected to said reset handle, said second linkage having a reset finger attached thereto;

wherein said motor controller is mounted in said body such that said reset button is depressed by said reset finger upon actuation of said reset handle.

4. An explosion-proof enclosure as in claim 3 wherein said metal body and said metal cover have aligned and opposing flanges and wherein said flanges have indentations forming regions of reduced width in the area of said reset handle, and wherein said reset handle is pivotable in an arcuate path passing through said indentations.

5. An explosion-proof electrical assembly, comprising:

a body for housing electrical components;

a cover for said body, said body and said cover being fastened together to form an explosion-proof enclosure;

a motor controller mounted in said body, said motor controller including a depressible reset button;

an external reset handle pivotably mounted on the side of said body;

linkage inside said body connected to said reset handle, said linkage having a reset finger for depressing said reset button;

wherein said motor controller is mounted in said body such that said reset button is depressed by said reset finger upon actuation of said reset handle.

6. The electrical assembly of claim 5 wherein said linkage comprises a reset hinge pivotably mounted inside said body, said reset finger being connected to and extending from said reset hinge.

7. The electrical assembly of claim 5, further comprising opposing flanges on said body and said cover forming an explosion-proof joint therebetween, wherein said flanges include indentations adjacent to said reset handle, said indentations defining flange segments of reduced width, and wherein said reset handle is pivotable in an arcuate path which passes through said indentations.

8. The electrical assembly of claim 7 wherein said body and said cover are fastened together with fasteners disposed in aligned holes formed through said flanges and wherein said flange segments of reduced width are free of said holes.

9. The electrical assembly of claim 6 wherein said explosion-proof enclosure has a rectangular shape and wherein said reset handle is mounted on said body such that said handle is substantially flush with the peripheral edge of said flanges.

10. An electrical assembly, comprising:

an explosion-proof enclosure including a base and a removable cover;

a circuit breaker mounted in said base, said circuit breaker having an actuator switch;

an external operating handle pivotably mounted on the side of said base;

a bail member pivotably mounted in said base and connected to said external operating handle by a linkage, said bail member including means for engaging said actuator switch of said circuit breaker;

a motor controller mounted in said base, said motor controller including a depressible reset button extending therefrom;

an external reset handle pivotably mounted on the side of said base;

a reset hinge pivotably mounted in said base and connected to said external reset handle, said reset hinge including an extending finger for depressing said reset button of said motor controller;

wherein said circuit breaker and said motor controller are mounted in said base such that said actuator switch is actuated by said bail upon actuation of said operating handle and wherein said reset button is depressed by said reset finger upon actuation of said reset handle.

11. The assembly of claim 10 further comprising aligned flanges formed on said base and said cover wherein said flanges are of reduced width in the regions adjacent to said operating handle and said reset handle, said regions of reduced width comprising indentations, and wherein said operating handle and said reset handle are each pivotable in an arcuate path passing through one of said indentations.

12. The assembly of claim 11 wherein said cover and said base are fastened together with bolts disposed through aligned holes in said flanges, said regions of reduced width being free of said holes.

13. The assembly of claim 12 wherein said enclosure is generally rectangular in shape and wherein said operating handle and said dreset handle are mounted on said base such that said handles do not substantially increase the overall width of said enclosure.

14. The assembly of claim 12 wherein said enclosure is generally rectangular in shape and wherein said operating handle and said reset handles are substantially flush with the peripheral edge of said flanges.

15. The assembly of claim 10 wherein said reset finger is pivotable from a first position in which said finger extends from said reset hinge in a direction substantially perpendicular to the direction that said reset button extends from said motor controller to a second position in alignment with said reset button upon actuation of said reset handle.

16. The assembly of claim 15 wherein said means for engaging said actuator switch of said circuit breaker comprises a slot formed in said bail.

* * * * *

UNITED STATES PATENT AND TRADEMARK OFFICE

CERTIFICATE OF CORRECTION

PATENT NO. : 4,965,414

DATED : October 23, 1990

INVENTOR(S) : Edward W. Sobotka, Jr., Martin P. Piraino, Jr.

It is certified that error appears in the above—identified patent and that said Letters Patent is hereby corrected as shown below:

Column 1, line 28, delete "desireable" and insert -- desirable --.

Column 4, line 62, delete "dreset" and insert -- reset --.

Signed and Sealed this

Nineteenth Day of May, 1992

*Attest:*

DOUGLAS B. COMER

*Attesting Officer*

*Acting Commissioner of Patents and Trademarks*